United States Patent [19]

Salvato

[11] 4,390,038

[45] Jun. 28, 1983

[54] MAGNETICALLY LOCKED VALVE

[76] Inventor: Guido A. Salvato, 944 Cathedral Ave., Franklin Square, N.Y. 11010

[21] Appl. No.: 348,423

[22] Filed: Feb. 12, 1982

[51] Int. Cl.[3] ..... F16K 35/06; F16K 35/16; F16K 31/08

[52] U.S. Cl. ..... 137/296; 70/276; 81/53 R; 81/90 C; 137/382; 137/384.8; 192/84 PM; 251/65; 251/89; 251/291; 403/DIG. 1

[58] Field of Search ..... 137/272, 291, 296, 299, 137/382, 383, 384.2, 384.8; 81/90 C, 53 R; 251/65, 89, 291; 192/84 PM, 108, 67 R; 70/276; 403/DIG. 1

[56] References Cited

U.S. PATENT DOCUMENTS

| | | | |
|---|---|---|---|
| 1,553,953 | 9/1925 | O'Brien | 137/299 |
| 2,289,574 | 7/1942 | Carlson | 251/65 |
| 3,453,897 | 7/1969 | Adinolfi | 137/296 |
| 3,840,041 | 10/1974 | McMurray | 251/65 |
| 3,916,939 | 11/1975 | Gillard | 137/296 |
| 3,939,861 | 2/1976 | Thompson | 137/299 |

*Primary Examiner*—George L. Walton

*Attorney, Agent, or Firm*—Scully, Scott, Murphy & Presser

[57] ABSTRACT

A magnetically locked fluid valve having a particular utility in a fire hydrant to prevent unauthorized usage thereof. The fire hydrant includes an operating nut mounted on top of one end of a hydrant actuator shaft, and a magnetic lock is located in immediate proximity thereto. A shaped magnet is adapted to be placed around the actuator shaft adjacent to the magnetic lock, after which a wrench can be applied to the operating nut to control operation of the fire hydrant. The magnetic lock includes magnetic tumblers which are shifted in position in response to placement of the magnet on the actuator shaft. The actuator shaft includes an upper section coupled to the operating nut and a lower section coupled to the hydrant valve. The magnetic lock is positioned between the upper and lower shaft sections, and the upper shaft section is freely rotatable relative to the lower section when the magnet is removed, but is locked relative thereto when the magnet is positioned thereon.

6 Claims, 4 Drawing Figures

MAGNETICALLY LOCKED VALVE

BACKGROUND OF THE INVENTION

1. Field of the Invention

The present invention relates generally to a locking arrangement for preventing unauthorized operation of a flow control valve, and more particularly pertains to a magnetically locked fluid valve designed for a fire hydrant to prevent unauthorized usage thereof.

2. Discussion of the Prior Art

Fire hydrants in prevelant usage today comprise a stand pipe which extends upwardly from an elbow which is connected to the main water supply pipe line. A control valve is located at the juncture between the bottom of the stand pipe and the elbow for controlling the flow of water to the fire hydrant. At its upper end, the stand pipe is provided with an above ground portion of barrel which includes at least one steamer nozzle or outlet nozzle extending laterally therefrom. A control valve operating rod also extends upwardly from the control valve through the barrel portion to the top thereof whereat it is accessible to authorized personnel for opening the control valve when desired, such as in the case of a fire when a fire hose is connected to the fire hydrant.

Unfortunately, a fire hydrant of this type is completely unprotected against unauthorized usage and may be operated at will by nonauthorized persons. The resultant water loss, and drop in water pressure, is a matter of serious concern to many cities.

Unauthorized persons are able to open the fire hydrant by gaining access to an operating nut at the upper end of the operating rod and opening the control valve.

Prior art attempts to prevent the unauthorized operation of fire hydrants have generally been directed to preventing access to the operating mechanism at the upper end of the barrel. However, this has not proved to be a satisfactory solution, and the problem in most cities is still a very serious one which has not been solved.

Thompson U.S. Pat. No. 3,939,861 is of interest by disclosing a fire hydrant designed to prevent unauthorized use of an outlet nozzle which is located on the above ground barrel portion of the stand pipe. The hydrant includes a valve located within the barrel portion and provided with a valve member which is spring biased to a closed position extending across the upstream end of the outlet nozzle. A valve actuator is provided for moving the valve member from its closed position to its open position against the bias of the spring means. To this end, a collar is adapted to be mounted on the fire hydrant by authorized persons in a position surrounding the outlet nozzle. The collar carries a valve actuating member which is arranged to move into the outlet nozzle to contact the valve member to move it from a closed position to an open position as the collar is mounted on the fire hydrant. In summary this arrangement is rather complex, and would be an extremely expensive system to emplement when considering all of the replacement fire hydrants and hose collars required thereby.

SUMMARY OF THE INVENTION

Accordingly, it is a primary object of the present invention to provide a magnetically locked fluid valve which has utility in many flow control environments such as petroleum or gas distribution or delivery systems and has particular utility to fire hydrants to prevent unauthorized usage thereof.

A further object of the subject invention is the provision of a magnetically locked valve for a fire hydrant which can be retrofitted to existing hydrants with a minimal replacement of parts.

In accordance with the teachings herein, the present invention provides a magnetically locked fluid valve having a valve seat and a valve element movable relative thereto between open and closed positions. A rotatably mounted valve actuator shaft is externally accessible on the locked valve, and when coupled thereto allows the valve to be opened or closed.

A magnetic lock is provided to couple the actuator shaft to the valve in response to a shaped magnet being properly positioned relative thereto, and also to decouple the actuator shaft from the valve responsive to the magnet being removed. The magnetically locked fluid valve is particularly designed to be utilized in combination with a fire hydrant to prevent unauthorized usage thereof, but should also have utility in other areas wherein unauthorized control of a fluid valve may be a problem.

In greater detail, the fire hydrant includes an operating nut mounted on top thereof at one end of the actuator shaft, and the magnetic lock is located in immediate proximity thereto. The shaped magnet has an opening adapted to be placed around the end of the actuator shaft adjacent to the nut such that a wrench can be applied thereto after the shaped magnet is positioned on the shaft. The magnetic lock includes magnetic tumblers which are shifted in position in response to placement of the magnet around the actuator shaft, and in a preferred embodiment the magnetic lock actually forms a part of the actuator shaft. In greater detail, the actuator shaft has an upper section by the operating nut and a lower section coupled to the valve. The magnetic lock is positioned between the upper and lower shaft sections, such that the upper shaft section is freely rotatable relative to the lower section when the magnet is removed, but is locked relative thereto when the magnet is placed around the actuator shaft. In one disclosed embodiment the magnetic tumblers are steel bars axially displaceable along the shaft in axial recesses therein, and extend between axial recesses in the upper and lower shaft sections when the shaped magnet is placed around the shaft, thereby coupling those elements together.

BRIEF DESCRIPTION OF THE DRAWINGS

The foregoing objects and advantages of the present invention for a magnetically locked valve may be more readily understood by one skilled in the art with reference being had to the following detailed description of several preferred embodiments thereof, taken in conjunction with the accompanying drawings wherein like elements are designated by identical reference numerals throughout the several drawings, and in which.

DETAILED DESCRIPTION OF THE DRAWINGS

Figure 1:
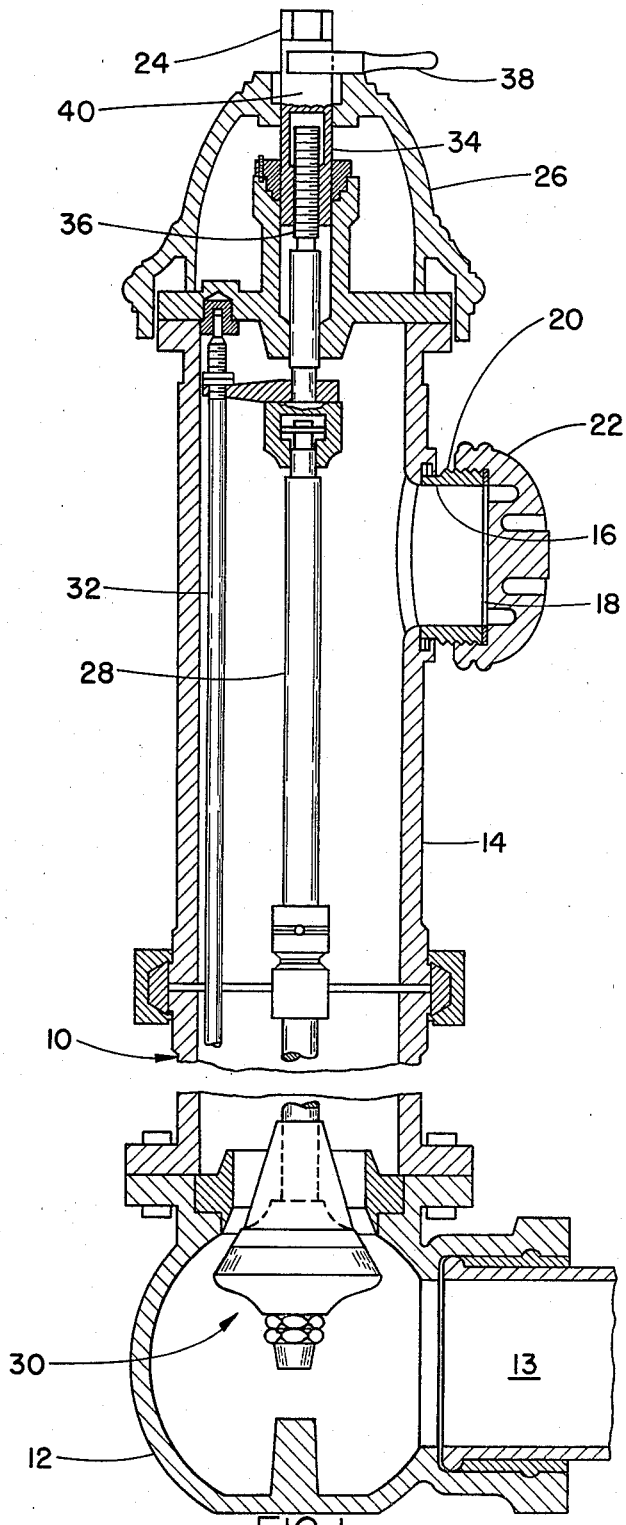
FIG. 1 is an elevational partially sectional view of an exemplary embodiment of a magnetically locked fire hydrant constructed pursuant to the teachings of the present invention.

Referring to the drawings in detail, in FIG. 1 a fire hydrant in accordance with the present invention comprises a usual stand pipe 10 which is connected at its bottom end to a conventional elbow casting 12 located underground and connected to the main water supply pipe 13 as is conventional in the art. Above ground, the hydrant comprises a barrel portion 14, which has a laterally extending steamer or outlet nozzle 16 mounted thereon and having a circular opening 18. The nozzle 16 is provided with external threads 20 which are engageable by a cap 22 for closing the nozzle 16 when the fire hydrant is not in use.

Operation of the fire hydrant is controlled from the top thereof by means of a top operating nut 24 which is angular and projects above a hood 26 threadedly mounted on the upper end of the barrel 14. The operating nut 24 is connected to an actuating shaft 28 connected to a conventional plug valve 30 at the lower end of the stand pipe 10 for controlling flow from the elbow casting into the lower end of the stand pipe 10. There is also provided a drip rod 32 which extends from the upper end of the barrel 14 downwardly to control a drip port (not shown), the construction of which is conventional in the art, and accordingly is not explained further herein.

Normally, operation of a fire hydrant of this type is controlled by applying a suitable wrench to operating nut 24, and turning the nut which in turn rotates an internally threaded actuator shaft 34 relative to an externally threaded actuator shaft 36 which in turn lowers or raises actuator shaft 28 to open or close plug valve 30. The present invention operates in substantially the same manner provided a shaped magnetic key 38 is properly positioned below operating nut 24 in proximity to a magnetic lock 40 forming a part of actuator shaft 34.

Figure 2:
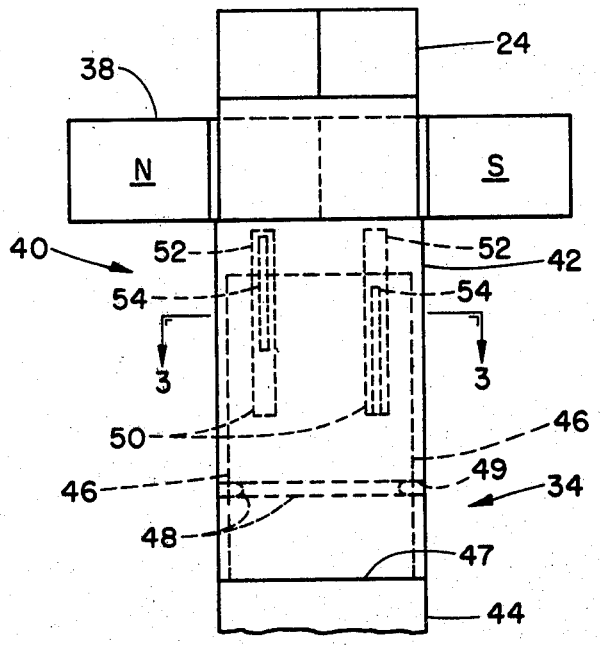
FIG. 2 illustrates an enlarged elevational view of the magnetic locking feature of the present invention.
Figure 3:
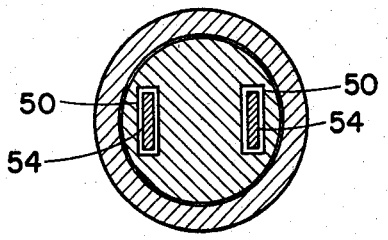
FIG. 3 is a sectional view along line 3—3 in FIG. 2 and illustrates further details of construction of the magnetic lock.

FIG. 2 illustrates an enlarged view in phantom of the magnetic lock 40 illustrating further details of construction thereof. Actuator shaft 34 is divided into an upper shaft section 42 having a coaxial cylindrical bore in its lower end and a lower shaft section 44 having a reduced diameter cylindrical end 46 starting at an annular shoulder 47, which projects into the cylindrical bore in the upper shaft section 42. Actuating shaft sections 42 and 44 are normally constructed from nonmagnetic materials for reasons as will become clear in the subsequent explanation. Reduced diameter cylindrical end 46 can have an annular groove 48 formed around its circumference and upper shaft section 42 can have one or more corresponding groove sections 49 formed therein such that pins such as a sectional C pin can be introduced between the groove 48 and groove sections 49 to anchor the upper and lower shaft sections 42 and 44 against axial movement therebetween while still allowing relative rotational movement.

The upper end of reduced diameter cylindrical section 46 has one or more axial recesses 50 formed therein which are rectangular in cross sectional shape in the illustrated embodiment. Likewise, the immediately adjacent end of the coaxial bore in the upper shaft section 42 has corresponding axial recesses 52 formed therein which may or may not be radially aligned depending upon the relative rotational positions of the shaft sections 42 and 44. Magnetic detents or tumblers 54, shown as having a rectangular cross sectional profile, are positioned in axial recesses 50, and are axially movable therein (under the influence of magnetic key 38) in an upward direction to extend between recesses 50 and 52 provided the recesses are rotationally aligned with each other.

Figure 4:
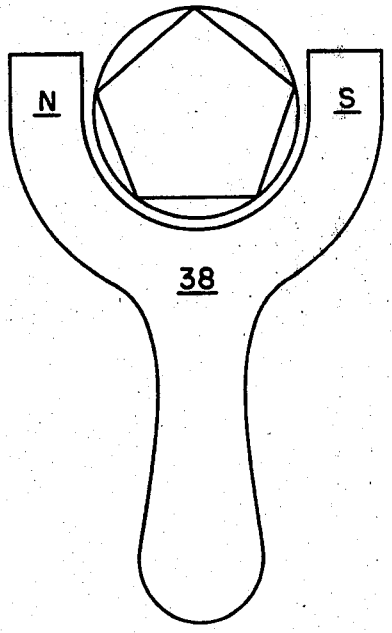
FIG. 4 is a plan view of the magnetic lock with a shaped magnet applied thereto.

In operation, without placement of a magnetic key 38 about actuator shaft 40, in a manner as shown in FIGS. 1 and 4, tumblers 54 rest fully in recesses 50 under the influence of gravity as shown on the right side of FIG. 2. If a wrench were applied to operating nut 24 in this condition, upper shaft section 42 would turn freely relative to lower shaft section 44, and it would appear to the person utilizing the wrench that the fire hydrant is broken.

Authorized usage of the fire hydrant is obtained by placing magnetic key 38 about actuator shaft 40 in a manner as shown in FIGS. 1 and 4, and then by turning operating nut 24 with a wrench. As shaft 42 is turned,-recesses 50 and 52 will at some point be aligned, at which the tumblers or detents 42 will be drawn upward under the influence of the magnetic force to the position shown on the left side of FIG. 2.

Upper and lower actuating shaft sections 42 and 44 are then rotationally locked to each other, and further turning of operation nut 24 will result in opening or closing of plug valve 30.

In alternative embodiments, other shaped detents 54, particularly round, and correspondingly shaped recesses 50 and 52 can be utilized. Moreover, the pattern and number of the recesses can vary from embodiment to embodiment. The arrangement of magnets on key 38 depends to a degree upon the pattern and number of the recesses. Moreover, in one contemplated embodiment, the magnetic key can be combined with a wrench to form in effect a magnetically keyed wrench.

The pesent invention can be easily and nonexpensively retrofitted to existing fire hydrants by a simple replacement of the standard internally threaded actuator shaft 34 with a shaft 34 constructed pursuant to the teachings of the present invention having a magnetic lock 40 incorporated therein.

Although the present invention for a magnetically locked valve has been described in context with a fire hydrant, it could also be utilized in other environments wherein the unauthorized tampering of fluid valves is a concern. For instance, the fluid control valves of petroleum or gas distribution or delivery systems or if reactors or plumbing systems could be constructed pursuant to the teachings of the present invention.

While several embodiments and variations of the present invention for a magnetically locked valve have been described in detail herein, it should be apparent that the disclosure and teachings of the present invention will suggest many alternative designs to those skilled in the art.

What is claimed is:

1. A magnetically locked fluid valve, comprising:

a. a valve, including a valve seat, and a valve element movable relative to the valve seat between an open position in which the valve element is separated from the valve seat to allow fluid to flow through the valve, and a closed position in which the valve element is closed against the valve seat to prevent fluid from flowing therethrough;

b. a rotatably mounted valve actuator shaft coupled to said valve element and having an externally accessible and visible operating nut as a portion thereof to allow the valve to be opened and closed when the actuator shaft is coupled to said valve element; and c. a magnetic locking means positioned below said operating nut and being concealed internally of the magnetically locked valve such that it is not externally visible and being positioned between; an upper actuator shaft section having said operating nut at the upper end thereof and a lower actuator shaft section coupled to said valve element, for coupling said upper and lower actuator shaft sections to enable said valve element to be opened or closed by said operating nut when a shaped magnet is properly positioned relative to the upper actuator shaft section, and for decoupling said upper and lower actuator shaft section to prevent unauthorized actuation of said valve element when the shaped magnet is removed fom the upper actuator shaft section.

2. A magnetically locked fluid valve as claimed in claim 1 in combination with a fire hydrant to prevent unauthorized usage of the hydrant.

3. A magnetically locked fire hydrant as claimed in claim 2 in combination with a shaped magnet having an opening through which the end of said upper actuator shaft section adjacent to said operating nut extends.

4. A magnetically locked fire hydrant as claimed in claim 3, said magnetic locking means including magnetic tumblers which are shifted in position in response to the shaped magnet being placed around said upper actuator shaft section.

5. A magnetically locked fire hydrant as claimed in claim 3, said upper shaft section being freely rotatable relative to said shaft section when said shaped magnet is removed and being locked relative to said lower shaft section when said magnetic tumblers are shifted in position in response to the shaped magnet being placed around said upper actuator shaft.

6. A magnetically locked fire hydrant as claimed in claim 5 said magnetic tumblers being steel bars axially slidable between said actuator shaft sections and being in axial recesses in said lower shaft section when said shaped magnet is removed and extending between axial recesses in said upper and lower shaft sections when the shaped magnet is placed around said upper actuator shaft.

* * * * *